US010672555B2

(12) United States Patent
Fukuda et al.

(10) Patent No.: US 10,672,555 B2
(45) Date of Patent: Jun. 2, 2020

(54) SURFACE-MOUNTABLE COIL ELEMENT

(71) Applicant: TAIYO YUDEN CO., LTD., Tokyo (JP)

(72) Inventors: Kentaro Fukuda, Tokyo (JP); Toshio Hiraoka, Tokyo (JP)

(73) Assignee: TAIYO YUDEN CO., LTD., Tokyo (JP)

( * ) Notice: Subject to any disclaimer, the term of this patent is extended or adjusted under 35 U.S.C. 154(b) by 84 days.

(21) Appl. No.: 15/705,746

(22) Filed: Sep. 15, 2017

(65) Prior Publication Data

US 2018/0096783 A1 Apr. 5, 2018

(30) Foreign Application Priority Data

Sep. 30, 2016 (JP) ..... 2016-194285

(51) Int. Cl.
*H01F 5/00* (2006.01)
*H01F 27/34* (2006.01)
(Continued)

(52) U.S. Cl.
CPC ..... *H01F 27/346* (2013.01); *H01F 17/0013* (2013.01); *H01F 17/04* (2013.01);
(Continued)

(58) Field of Classification Search
CPC ..... H01F 27/365; H01F 2017/008; H01F 2017/0066
(Continued)

(56) References Cited

U.S. PATENT DOCUMENTS 6,373,368 B1 * 4/2002 Shikama ..... H01F 41/04 29/605
2010/0182116 A1 7/2010 Ishimoto et al.
(Continued)

FOREIGN PATENT DOCUMENTS

JP 1-129817 U 9/1989
JP 11-130524 A 5/1999
(Continued)

OTHER PUBLICATIONS

Notice of Reasons for Refusal dated Mar. 24, 2020 issued in corresponding Japanese Patent Application No. JP 2016-194285 with English translation.

*Primary Examiner* — Ronald Hinson
(74) *Attorney, Agent, or Firm* — Pillsbury Winthrop Shaw Pittman, LLP

(57) ABSTRACT

One object is to provide a new type of coil element capable of reducing leakage magnetic flux. A coil element according to one embodiment of the present invention is provided with an insulator body made of a magnetic material and having a mounting surface and an upper surface opposed to said mounting surface, a coil conductor embedded in the insulator body, an external electrode electrically connected to the coil conductor, a shield layer provided on the upper surface of the insulator body and having a larger magnetic permeability than the insulator body, and a plating layer formed to cover the mounting surface of the external electrode and having a larger magnetic permeability than the insulator body. The plating layer is formed to be thicker than the shield layer.

17 Claims, 11 Drawing Sheets

(51) Int. Cl.

| | |
|---|---|
| ***H01F 17/00*** | (2006.01) |
| ***H01F 17/04*** | (2006.01) |
| ***H01F 27/29*** | (2006.01) |
| ***H01F 27/36*** | (2006.01) |

(52) U.S. Cl.
CPC ..... *H01F 27/292* (2013.01); *H01F 27/365* (2013.01); *H01F 2017/008* (2013.01); *H01F 2017/0066* (2013.01)

(58) Field of Classification Search
USPC ..... 336/200
See application file for complete search history.

(56) References Cited

U.S. PATENT DOCUMENTS

2012/0105188 A1* 5/2012 Lim ..... H01F 17/0033 336/200
2013/0249662 A1* 9/2013 Tonoyama ..... H01F 27/255 336/200
2015/0009003 A1 1/2015 Ozawa et al.
2016/0086716 A1* 3/2016 Choi ..... H01F 27/292 336/221
2016/0086717 A1* 3/2016 Harada ..... H01F 27/255 336/233
2016/0172098 A1* 6/2016 Jeong ..... H01F 17/0013 336/90
2018/0366246 A1* 12/2018 Park ..... H01F 17/0013

FOREIGN PATENT DOCUMENTS

| | | | |
|---|---|---|---|
| JP | 2004-266120 | A | 9/2004 |
| JP | 2009-055412 | A | 3/2009 |
| JP | 2013-201374 | A | 10/2013 |
| JP | 2015-015297 | A | 1/2015 |
| JP | 2016-115935 | A | 6/2016 |
| WO | 2007/119426 | A1 | 10/2007 |
| WO | 2016/021938 | A1 | 2/2016 |

* cited by examiner

SURFACE-MOUNTABLE COIL ELEMENT

CROSS-REFERENCE TO RELATED APPLICATIONS

This application is based on and claims the benefit of priority from Japanese Patent Application Serial No. 2016-194285 (filed on Sep. 30, 2016), the contents of which are hereby incorporated by reference in their entirety.

TECHNICAL FIELD

The present invention relates to a surface-mountable coil element.

BACKGROUND

One type of surface-mountable coil element is an inductor. In a power source line or a signal line, the inductor is used to, for example, eliminate noise.

Typically, a coil element has an insulator body, a coil conductor embedded in said insulator body, and an external electrode connected to an end portion of said coil conductor. Such a coil element is soldered to a circuit board via the external electrode.

The coil element presents a problem that magnetic flux that has penetrated an inside of the coil conductor leaks to an outside of said coil element, and the magnetic flux that has leaked to the outside (referred to as "leakage magnetic flux") affects an operation of any other component.

There have been proposed coil elements intended to prevent or suppress leakage magnetic flux. For example, Japanese Patent Application Publication No. 2004-266120 discloses an inductor in which a magnetic path reinforcement layer 8 formed of iron foil is provided on a surface of a magnetic body 7 in which a coil 5 is embedded. The magnetic path reinforcement layer 8 is made of a magnetic material having a higher magnetic permeability than that of the magnetic body 7, and thus magnetic flux that has penetrated the coil 5 is guided to pass through the magnetic path reinforcement layer 8. As a result, magnetic flux is prevented from leaking to an outside of the inductor.

Furthermore, Japanese Patent Application Publication No. 2016-115935 discloses an inductor in which a metal magnetic plate 7 is provided in each of an upper portion and a lower portion of an insulator body 50 in which a coil is embedded. The metal magnetic plate 7 is made of a magnetic material having a larger magnetic permeability than a metal magnetic powder 51 contained in the insulator body 50, and thus magnetic flux that has penetrated the coil is prevented from leaking to an outside of said inductor.

SUMMARY

As mentioned above, it has been demanded that occurrence of leakage magnetic flux be prevented or suppressed in a coil element. One object of the present invention is to provide a new type of coil element capable of reducing leakage magnetic flux. Other objects of the present invention will be made apparent through description of the specification as a whole.

A coil element according to one embodiment of the present invention is provided with an insulator body made of a magnetic material, a coil conductor embedded in the insulator body, and an external electrode electrically connected to the coil conductor. Said insulator body has a mounting surface and an upper surface opposed to said mounting surface.

A coil element according to one embodiment of the present invention is provided further with a shield layer provided on the upper surface of the insulator body and having a larger magnetic permeability than the insulator body and a plating layer formed to cover a lower surface of the external electrode and having a larger magnetic permeability than the insulator body. In one embodiment of the present invention, the plating layer is formed to be thicker than the shield layer.

According to said embodiment, on an upper surface side of said coil element, magnetic flux that penetrates said coil conductor is guided to pass through the shield layer, while on a mounting surface side of said coil element, the magnetic flux is guided to pass through the plating layer. The plating layer is formed to cover the lower surface of the external electrode (a surface opposed to a circuit board) and to be thicker than the shield layer, and thus the external electrode can be reliably protected from heat used to solder the coil element to the circuit board. As described above, according to the coil element of the foregoing embodiment, leakage magnetic flux can be reduced by using the plating layer that protects the external electrode from heat used for soldering.

In one embodiment of the present invention, the external electrode has an upper portion covering at least part of an upper surface of the insulator body and a lower portion covering at least part of a mounting surface of the insulator body. A plating layer having a larger magnetic permeability than the insulator body is provided on each of an upper surface of the upper portion of the external electrode and a lower surface of the lower portion of the external electrode (a surface opposed to a circuit board).

According to said embodiment, on each of an upper surface side and a mounting surface side of said coil element, magnetic flux that penetrates said coil conductor is guided to pass through the plating layer. As described above, according to the coil element of the foregoing embodiment, leakage magnetic flux can be reduced by using the plating layer formed on the external electrode.

Advantages

According to one embodiment of the present invention, a new type of coil element capable of reducing leakage magnetic flux can be obtained.

DESCRIPTION OF THE PREFERRED EMBODIMENTS

Figure 1:
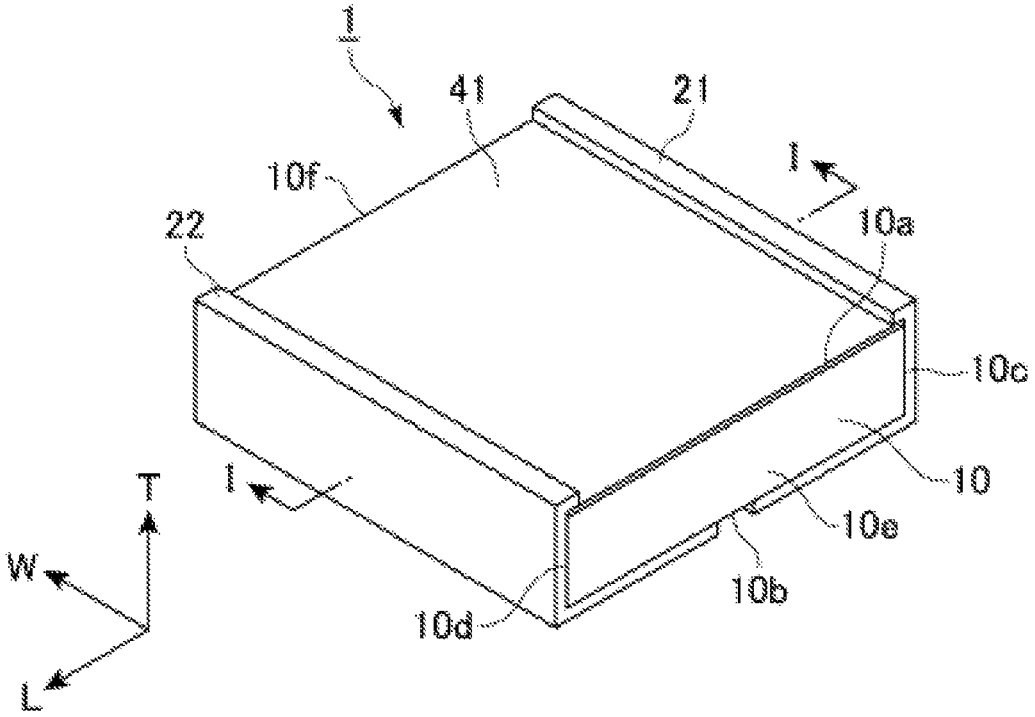
FIG. 1 is a perspective view of a coil element according to one embodiment of the present invention.

By referring appropriately to the appended drawings, the following describes various embodiments of the present invention. Constituent components common to a plurality of drawings are denoted by the same reference characters throughout said plurality of drawings. It is to be noted that, for the sake of convenience of description, the drawings are not necessarily depicted to scale.

Figure 2:
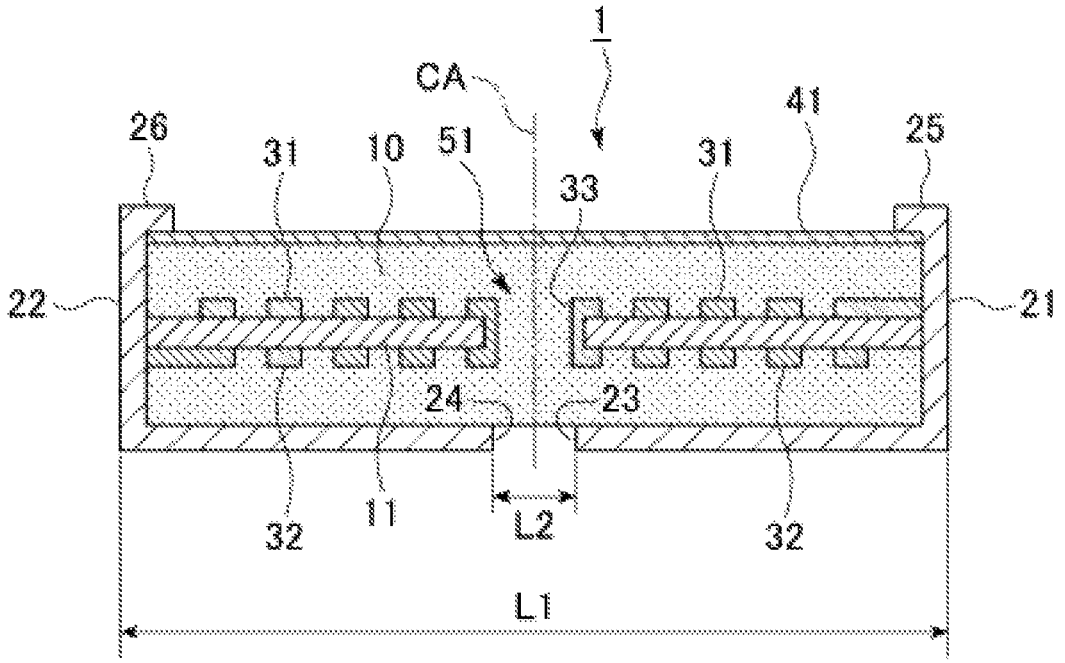
FIG. 2 is a sectional view of the coil element shown in FIG. 1 along a line I-I of FIG. 1.
Figure 3:
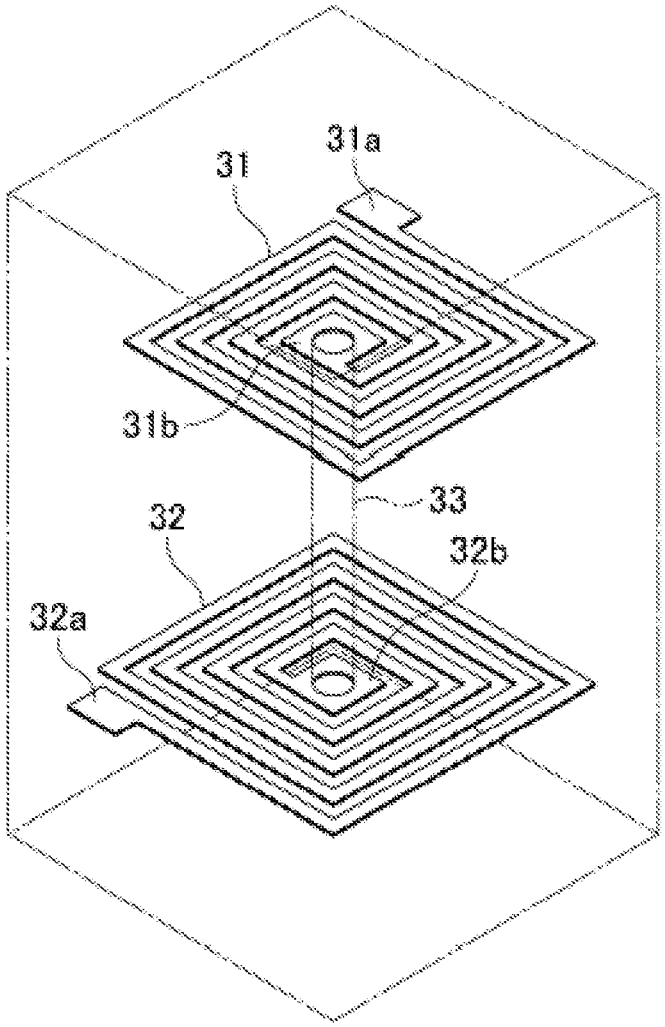
FIG. 3 is an exploded perspective view for schematically showing a coil conductor of the coil element shown in FIG. 1.
Figure 4:
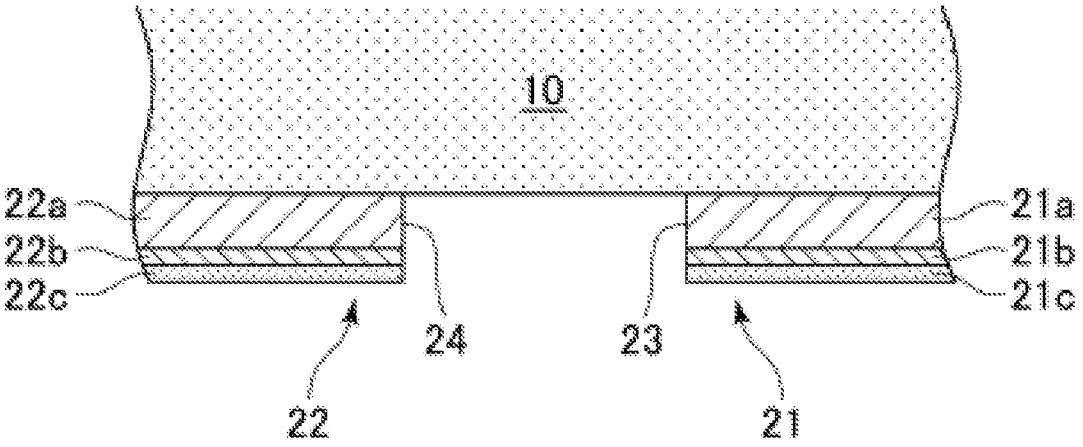
FIG. 4 is an enlarged sectional view showing on an enlarged scale, an external electrode shown in FIG. 2.

FIG. 1 is a perspective view of a coil element according to one embodiment of the present invention, and FIG. 2 is a sectional view of the coil element shown in FIG. 1 along a line I-I of FIG. 1. FIG. 3 is an exploded perspective view for schematically showing a coil conductor of the coil element shown in FIG. 1, and FIG. 4 is an enlarged sectional view of the coil element shown in FIG. 1, showing part of an external electrode on an enlarged scale.

Each of these figures shows, as one example of a coil element, a power inductor incorporated into a power source line. A power inductor may be one example of a coil element to which the present invention is applicable. The present invention may be applicable also to coil elements of other types than a power inductor, such as, for example, an inductor used in a signal line.

A coil element 1 in this embodiment shown in the figures may be provided with an insulator body 10 made of a magnetic material, a first coil conductor 31 and a second coil conductor 32 embedded in the insulator body 10, an external electrode 21 electrically connected to one end of said first coil conductor 31, an external electrode 22 electrically connected to one end of said second coil conductor 32, and a shield layer 41 provided on an upper surface of the insulator body 10. The insulator body 10 may have a first principal surface 10*a*, a second principal surface 10*b*, a first end surface 10*c*, a second end surface 10*d*, a first side surface 10*e*, and a second side surface 10*f*. Outer surfaces of the insulator body 10 may be defined by these six surfaces. The first principal surface 10*a* and the second principal surface 10*b* may be opposed to each other. The first end surface 10*c* and the second end surface 10*d* may be opposed to each other. The first side surface 10*e* and the second side surface 10*f* are opposed to each other. In FIG. 1, the first principal surface 10*a* lies on an upper side of the insulator body 10, and, therefore, in this specification, there may be a case where the first principal surface 10*a* is referred to as an upper surface". Similarly, there may be a case where the second principal surface 10*b* is referred to as a "lower surface". In the coil element 1, the second principal surface 10*b* may be disposed to be opposed to a circuit board (not shown), and, therefore, in this specification, there may be a case where the second principal surface 10*b* is referred to as a "mounting surface". Furthermore, it is assumed that an up-down direction of the coil element 1 refers to an up-down direction in FIG. 1.

In this specification, unless otherwise contextually construed, it is assumed that a "length" direction, a "width" direction, and a "thickness" direction of the coil element 1 are indicated as an "L" direction, a "W" direction, and a "T" direction in FIG. 1, respectively.

The coil element 1 according to one embodiment of the present invention may be formed in a shape of substantially a rectangular parallelepiped and have a dimension in the length direction (the L direction) of 0.1 mm to 2.0 mm, a dimension in the width direction (the W direction) of 0.05 mm to 1.25 mm, and a dimension in the thickness direction (the T direction) of 0.05 mm to 0.8 mm. The dimensions of the coil element 1 specified in this specification may be merely illustrative, and the coil element 1 can have arbitrary dimensions. The coil element 1 according to one embodiment of the present invention may be configured to have a dimension in the length direction larger than its dimension in the width direction. Furthermore, the coil element 1 according to one embodiment of the present invention may be configured to have a dimension in the width direction larger than its dimension in the thickness direction. In this case, the coil element 1 can be reduced in profile.

In one embodiment of the present invention, a plate-shaped insulating substrate 11 may be embedded in the insulator body 10. On an upper surface of the insulating substrate 11, the first coil conductor 31 may be provided as a planar coil. On a lower surface of the insulating substrate 11, the second coil conductor 32 may be provided as a planar coil. The first coil conductor 31 and the second coil conductor 32 may be electrically connected to each other via a through hole 33. Respective surfaces of the first coil conductor 31, the second coil conductor 32, and the through hole 33 may be coated with an insulating film. The first coil conductor 31 and the second coil conductor 32 may each be wound a plurality of turns about a coil axis CA into a spiral shape. The coil axis CA may be a virtual axis extending in the up-down direction (the T direction) of the coil element 1. In one embodiment, the coil axis CA may extend in a direction substantially orthogonal or completely orthogonal to the insulating substrate 11 (or a lower surface and an upper surface of the coil element 1).

The insulating substrate 11 may be made of a material having an excellent insulation property such as, for example, polypropylene glycol or ferrite and formed into a plate shape.

The first coil conductor 31 and the second coil conductor 32 may be formed on the insulating substrate 11 by plating or etching. The through hole 33 may be formed by embedding a metal material in penetration holes formed through the insulator body 10 and the insulating substrate 11, respectively. The first coil conductor 31, the second coil conductor 32, and the through hole 33 may be formed to contain a metal having excellent electrical conductivity and thus be made of, for example, Ag, Pd, Cu, Al, or any alloy of these elements.

An extraction electrode 31*a* may be provided in an outer peripheral side end portion of the first coil conductor 31. The first coil conductor 31 may be electrically connected to the external electrode 21 via the extraction electrode 31*a*. Similarly, an extraction electrode 32*a* may be provided in an outer peripheral side end portion of the second coil conductor 32. The second coil conductor 32 may be electrically connected to the external electrode 22 via the extraction electrode 32*a*.

A land 31*b* may be provided in an inner peripheral side end portion of the first coil conductor 31, and a land 32*b* may be provided in an inner peripheral side end portion of the second coil conductor 32. The first coil conductor 31 may be electrically connected to the through hole 33 via the land 31*b*, and the second coil conductor 32 may be electrically connected to the through hole 33 via the land 32*b*. As described above, the first coil conductor 31 and the second coil conductor 32 may be electrically connected to each other via the through hole 33.

The penetration hole may be formed in a center of the insulating substrate 11. The penetration hole may be filled with a magnetic material to form a core portion 51. The core portion 51 filled with the magnetic material is thus formed, so that an inductance (L) of the coil element 1 can be improved.

In one embodiment of the present invention, the insulator body 10 may be made of a resin in which a multitude of filler particles are dispersed. In another embodiment of the present invention, the insulator body 10 may be made of a resin containing no filler particles. In one embodiment of the present invention, the resin contained in the insulator body 10 is a thermosetting resin having an excellent insulation property. The insulator body 10 may be formed to have a thickness reduced by a thickness of the external electrode 21 (or the external electrode 22) with respect to a thickness of the coil element 1. Thus, the insulator body 10 may be formed to have a thickness of, for example, 0.04 mm to 0.78 mm.

Examples of a thermosetting resin used to form the insulator body 10 may include benzocyclobutene (BCB), an epoxy resin, a phenolic resin, an unsaturated polyester resin, a vinyl ester resin, a polyimide resin (PI), a polyphenylene ether (oxide) resin (PPO), a bismaleimide-triazine cyanate ester resin, a fumarate resin, a polybutadiene resin, and a polyvinyl benzyl ether resin.

In one embodiment of the present invention, filler particles used to form the insulator body 10 may be, for example, particles of a ferrite material, metal magnetic particles, particles of an inorganic material such as SiO2 or Al2O3, or glass-based particles. Particles of a ferrite material used to form the insulator body 10 may be, for example, particles of Ni—Zn ferrite or particles of Ni—Zn—Cu ferrite. Metal magnetic particles used to form the insulator body 10 may be of a material in which magnetism is developed in an unoxidized metal portion and may be, for example, particles including unoxidized metal particles or alloy particles. Metal magnetic particles applicable to the present invention may include particles of, for example, Fe, an Fe—Si—Cr, Fe—Si—Al, or Fe—Ni alloy, an Fe—Si—Cr—B—C or Fe—Si—B—Cr amorphous alloy, or a material obtained by mixing them. Pressurized powder bodies obtained from these types of particles can also be used as metal magnetic particles for the insulator body 10. Moreover, these types of particles or pressurized powder bodies obtained therefrom each having a surface thermally treated to form an oxidized film thereon can also be used as metal magnetic particles for the insulator body 10. Metal magnetic particles for the insulator body 10 may be manufactured by, for example, an atomizing method. Furthermore, metal magnetic particles for the insulator body 10 can be manufactured by any other known method than the atomizing method. Furthermore, commercially available metal magnetic particles can also be used as metal magnetic particles for the insulator body 10. Examples of commercially available metal magnetic particles may include PF-20F manufactured by Epson Atmix Corporation and SFR-FeSiAl manufactured by Nippon Atomized Metal Powders Corporation.

In the coil element 1 according to one embodiment of the present invention, the shield layer 41 may have a larger magnetic permeability than that of the insulator body 10. For example, the shield layer 41 may have a magnetic permeability five or more times, 10 more or times, or 50 or more times as high as that of the insulator body 10. Magnetic flux that has penetrated the core portion 51 of the insulator body 10 is guided to pass through the shield layer 41, and thus occurrence of leakage magnetic flux from the upper surface of the coil element 1 can be prevented.

In one embodiment of the present invention, the shield layer 41 may be provided on the upper surface of the insulator body 10 so as to cover the entirety of the upper surface of the insulator body 10. As long as leakage magnetic flux can be sufficiently suppressed, it may also be possible that the shield layer 41 is provided to cover only part of the insulator body 10.

In one embodiment of the present invention, the shield layer 41 may be formed by using nickel cobalt, iron, or any alloy of these metals as a principal ingredient. The shield layer 41 may be formed on the insulator body 10 by, for example, physical vapor deposition (PVD), chemical vapor deposition (CVD), or any other thin film process technology than these methods.

The shield layer 41 may have a thickness depending on a magnetic permeability thereof. Even when the shield layer 41 is formed to be thin, the larger a magnetic permeability of the shield layer 41, the more capable the shield layer 41 may be of preventing occurrence of leakage magnetic flux. In a case where the shield layer 41 is made of nickel having a relative magnetic permeability of 600, the shield layer 41 can be formed to have a thickness of 2 μm or less.

The shield layer 41 in one embodiment of the present invention may be configured to have a magnetic permeability that exhibits an anisotropy. Specifically, the shield layer 41 in one embodiment of the present invention may be configured so that a magnetic permeability thereof in a direction perpendicular to the coil axis CA is larger than that in a direction parallel to the coil axis CA. The shield layer 41 may be formed so that, for example, a magnetic permeability thereof in the direction perpendicular to the coil axis CA is two or more times that in the direction parallel to the coil axis CA. With this configuration, magnetic flux that has penetrated the core portion 51 of the insulator body 10 is guided to pass through the shield layer 41 in the length direction and the width direction, while hardly passing through the shield layer 41 in the thickness direction, and thus occurrence of leakage magnetic flux from the upper surface of the coil element 1 can be more reliably prevented.

In one embodiment, the shield layer 41 having a magnetic permeability that exhibits an anisotropy may contain a multitude of flat-shaped filler particles. Similarly to the filler particles contained in the insulator body 10, the filler particles contained in the shield layer 41 may be particles of a ferrite material, metal magnetic particles, particles of an inorganic material such as $SiO_2$ or Al2O3, or glass-based particles. The flat-shaped filler particles contained in the shield layer 41 may be set to have an aspect ratio (a flattening ratio) of, for example, 1.5 or more, 2 or more, 3 or more, 4 or more, or 5 or more. An aspect ratio of filler particles refers to a length of said particles in a longest axis direction with respect to a length thereof in a shortest axis direction (a length in the longest axis direction/a length in the shortest axis direction).

In one embodiment of the present invention, the flat-shaped filler particles contained in the shield layer 41 may be contained in the shield layer 41 so as to assume such a posture that a long axis of the filler particles is oriented to the direction perpendicular to the coil axis CA and a short axis thereof is oriented to the direction parallel to the coil axis CA. With the filler particles assuming such a posture, a magnetic permeability of the shield layer 41 in the direction parallel to the coil axis CA (the thickness direction (the T direction) of the coil element 1) may become larger than that in the direction perpendicular to the coil axis CA (the length direction (the L direction) and the width direction (the W direction)).

In one embodiment of the present invention, the filler particles contained in the shield layer 41 may be configured to have a thickness in the short axis direction of 2 μm or less. With this configuration, the shield layer 41 can be formed to be thin.

The external electrode 21 and the external electrode 22 may be provided on surfaces of the insulator body 10. In one embodiment of the present invention, as shown in FIG. 2, the external electrode 21 and the external electrode 22 may each be formed so that a length thereof in the length direction (the L direction) is longer on the mounting surface of the coil element 1 than on the upper surface. On the mounting surface of the coil element 1, the external electrode 21 and the external electrode 22 may be disposed away from each other in the length direction (the L direction), so that a distance having a width L2 may be generated between an inner side end surface 23 of the external electrode 21 and an inner side end surface 24 of the external electrode 22. In one embodiment of the present invention, the distance L2 between the inner side end surface 23 of the external electrode 21 and the inner side end surface 24 of the external electrode 22 may be configured so that a ratio between the distance L2 and a dimension L1 of the coil element 1 in the length direction (the L direction) (L2/L1) is 0.3 or less, 0.25 or less, 0.2 or less, 0.15 or less, or 0.1 or less.

The external electrode 21 may be formed so that an upper portion 25 thereof covers an outer side end portion of the shield layer 41 from above. Similarly, the external electrode 22 may be formed so that an upper portion 26 thereof covers an outer side end portion of the shield layer 41 from above. With this configuration, the shield layer 41 can be prevented from peeling off from the insulator body 10.

In one embodiment of the present invention, as shown in FIG. 4, the external electrode 21 may have a base electrode 21*a*, a first plating layer 21*b* covering the base electrode 21*a*, and a second plating layer 21*c* covering the first plating layer 21*b*. Similarly, the external electrode 22 may have a base electrode 22*a*, a first plating layer 22*b* covering the base electrode 22*a*, and a second plating layer 22*c* covering the first plating layer 22*b*. The base electrode 21*a* and the base electrode 22*a* may be electrically connected to the coil conductor 31 and the coil conductor 32, respectively.

The base electrode 21*a* and the base electrode 22*a* may each be formed by, for example, applying a paste-like electrically conductive material to the surfaces of the insulator body 10 and curing the electrically conductive material thus applied. As an electrically conductive material for the base electrode 21*a* and the base electrode 22*a*, there can be used, for example, a metal material such as copper (Cu), nickel (Ni), silver (Ag), palladium (Pd), gold (Au), or the like or an alloy material including one or more of these metal materials. Examples of an alloy material mentioned here may include a Cu—Ni alloy.

The first plating layer 21*b* may be formed to cover the entirety of a surface of the base electrode 21*a* to protect the base electrode 21*a*. Similarly, the first plating layer 22*b* may be formed to cover the entirety of a surface of the base electrode 22*a* to protect the base electrode 22*a*. In one embodiment of the present invention, the first plating layer 21*b* and the first plating layer 22*b* may be formed to have a thickness thicker than that of the shield layer 41. Each of the first plating layer 21*b* and the first plating layer 22*b* can be set to have a thickness of, for example, 1 μm to 20 μm. With each of the first plating layer 21*b* and the first plating layer 22*b* set to have a thickness of about 1 μm, when the coil element 1 is soldered to a circuit board, the base electrode 21*a* and the base electrode 22*a* can be sufficiently protected. In consideration of reliability with respect to change over time, the first plating layer 21*b* and the first plating layer 22*b* can also be set to have a thickness of 2 μm or more. Furthermore, in a case where the coil element 1 is used in a high-temperature environment or a case where the coil element 1 is required to have high resistance to vibration, the first plating layer 21*b* and the first plating layer 22*b* can be set to have a thickness of 10 μm to 20 μm.

The first plating layer 21*b* and the first plating layer 22*b* may be formed to have a larger magnetic permeability than that of the insulator body 10. In one embodiment of the present invention, the first plating layer 21*b* and the first plating layer 22*b* may each be a nickel plating layer containing nickel (Ni). With the first plating layer 21*b* and the first plating layer 22*b* formed of a nickel plating layer, the first plating layer 21*b* and the first plating layer 22*b* may have a relative dielectric constant of approximately 600.

In one embodiment of the present invention, the second plating layer 21*c* and the second plating layer 22*c* may each be a tin plating layer containing tin (Sn).

Figure 5A:
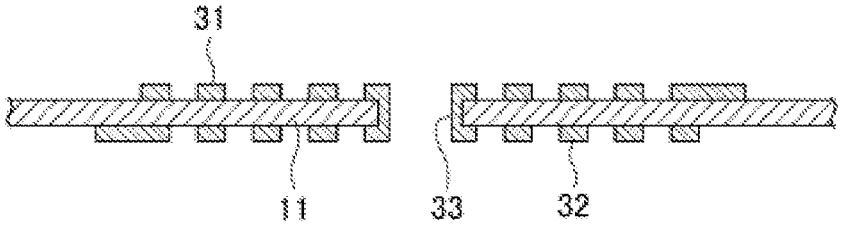
FIG. 5*a* is a view showing a process step for manufacturing the coil element according to one embodiment of the present invention.

Next, by sequentially referring to FIG. 5*a* to FIG. 5*e*, a description is given of a method for manufacturing the coil element 1. First, as shown in FIG. 5*a*, the insulating substrate 11 may be prepared, and a penetration hole may be formed at a center of the insulating substrate 11. The penetration hole may be formed by drilling, laser, sandblast, a punching process, or an arbitrary known technique other than these techniques. Next, the through hole 33 may be formed on an inner peripheral surface of the penetration hole. The through hole 33 may be formed by, for example, performing electrolytic plating on a seed layer formed by sputtering non-electrolytic plating, or the like. It may also be possible that the through hole 33 is formed by direct plating without forming a seed layer.

Next, the coil conductor 31 and the coil conductor 32 may be formed on both surfaces of the insulating substrate 11, respectively. The coil conductor 31 and the coil conductor 32 may be formed by plating, etching, a printing method, a transcription method, or an arbitrary known method other than these techniques.

Figure 5B:
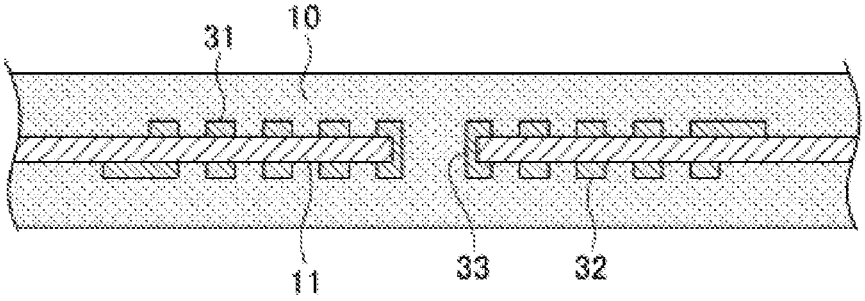
FIG. 5*b* is a view showing a process step for manufacturing the coil element according to one embodiment of the present invention.

Next, as shown in FIG. 5*b*, the insulator body 10 may be formed on both surfaces of the insulating substrate 11. The insulator body 10 may be formed by a lamination method, a hydrostatic pressure pressing method, or the like by using a resin containing a filler. A resin containing a filler mentioned here may be filled also in the above-mentioned penetration hole of the insulating substrate 11.

Figure 5C:
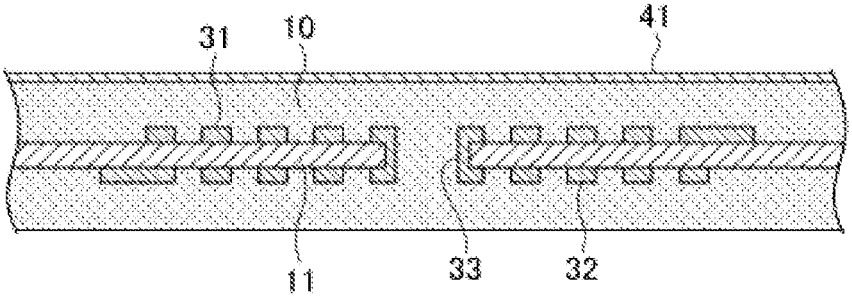
FIG. 5*c* is a view showing a process step for manufacturing the coil element according to one embodiment of the present invention.

Next, as shown in FIG. 5*c*, a laminate may be obtained by forming the shield layer 41 on the upper surface of the insulating substrate 11. The shield layer 41 may be formed by, for example, a thin film process so as to have a thickness of 2 μm or less. It may also be possible that the shield layer 41 is formed by the lamination method, the hydrostatic pressure pressing method, or the like by using a resin containing flat-shaped filler particles.

Figure 5D:
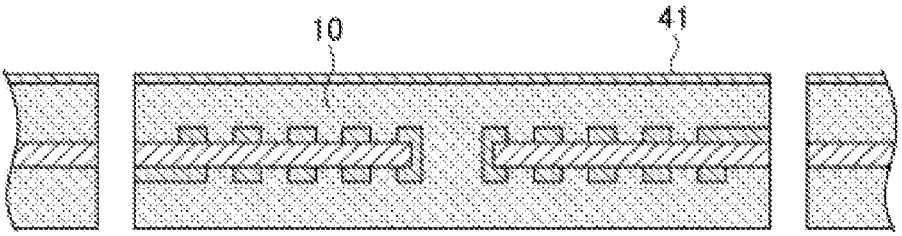
FIG. 5*d* is a view showing a process step for manufacturing the coil element according to one embodiment of the present invention.

Next, as shown in FIG. 5*d*, the laminate shown in FIG. 5*c* may be cut into a unit element size. In this manner, a unit element sized-laminate may be obtained.

Figure 5E:
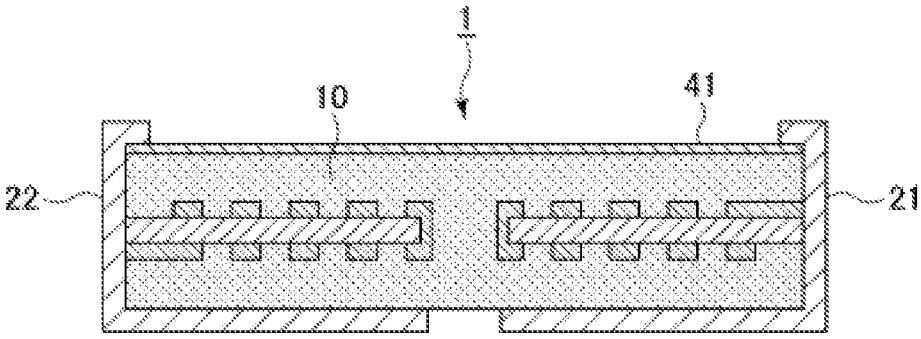
FIG. 5*e* is a view showing a process step for manufacturing the coil element according to one embodiment of the present invention.

Next, as shown in FIG. 5*e*, the external electrode 21 and the external electrode 22 may be formed on the laminate shown in FIG. 5*d* The external electrode 21 may be obtained by applying an electrically conductive paste on the surfaces of the insulator body 10 to form the base electrode 21*a*, forming the first plating layer 21*b* on the surface of the base electrode 21*a*, and forming the second plating layer 21*c* on a surface of the first plating layer 21*b*. The external electrode 22 may be formed by a similar method to the method for forming the external electrode 21.

By following process steps thus described, the coil element 1 according to one embodiment of the present invention may be obtained. The above-mentioned method for manufacturing the coil element 1 may be merely one example, and a method for manufacturing the coil element 1 may not be limited thereto.

According to the coil element 1 of one embodiment of the present invention, on an upper surface side of the coil element 1, magnetic flux that penetrates the coil conductor 31 and the coil conductor 32 may be guided to pass through the shield layer 41, while on a mounting surface side of the coil element 1, the magnetic flux may be guided to pass through the first plating layer 21*b* and the first plating layer 22*b*. The first plating layer 21*b* and the first plating layer 22*b* may be formed to cover the entirety of the surfaces of the base electrode 21*a* and the base electrode 22*a*, respectively, and formed to be thicker than the shield layer 41, and thus the base electrode 21*a* and the base electrodes 22*a* can be reliably protected from heat used to solder the coil element 1 to a circuit board (not shown). As described above, according to the coil element 1 of one embodiment of the present invention, leakage magnetic flux can be reduced by using the first plating layer 21*b* and the first plating layer 22*b* that protect the base electrode 21*a* and the base electrode 22*a*, respectively, from heat used for soldering. As described above, on the mounting surface side of the coil element 1, occurrence of leakage magnetic flux may be prevented by the first plating layer 21*b* and the first plating layer 22*b* necessary for the base electrode 21*a* and the base electrode 22*a*, respectively, and thus there may be no need to provide any additional layer other than the first plating layer 21*b* and the first plating layer 22*b* on the mounting surface side of the coil element 1. Thus, said coil element 1 can be configured to be reduced in profile compared with a case where any additional layer is provided. Furthermore, as mentioned above, the coil element 1 according to one embodiment of the present invention may be configured to have a dimension in the width direction larger than a dimension thereof in the thickness direction. In this case, in the coil element 1 thus reduced in profile, occurrence of leakage magnetic flux can be prevented.

Figure 6:
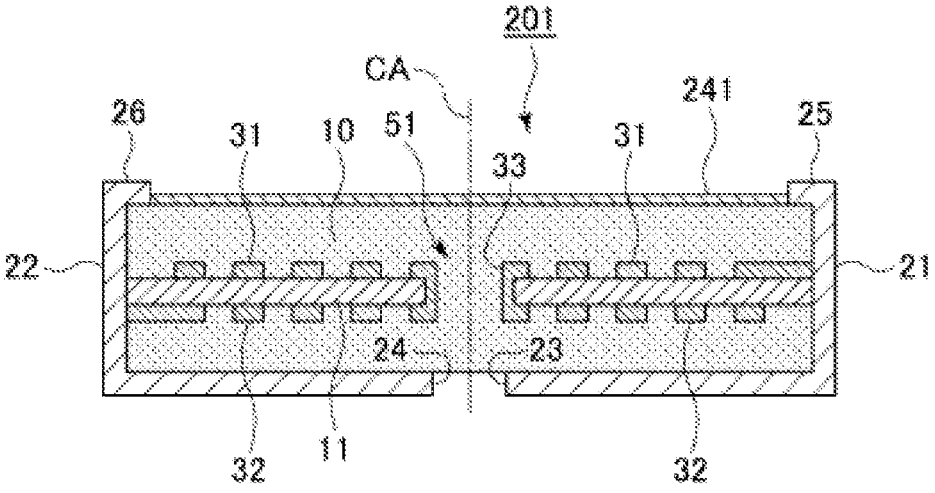
FIG. 6 is a sectional view of a coil element according to another embodiment of the present invention.

The coil element 1 shown in FIG. 1 to FIG. 4 may be merely one example of the embodiment of the present invention, and various other embodiments may be envisaged. For example, FIG. 6 shows a coil element 201 according to another embodiment of the present invention. The coil element 201 shown in FIG. 6 may be provided with a shield layer 241 in place of the shield layer 41 of the coil element 1 shown in FIG. 2. The shield layer 241 may have a dimension in the length direction smaller than that of the shield layer 41. More specifically, the shield layer 241 may be formed so that a dimension thereof in the length direction is substantially equal to a distance between an inner side end surface of the upper portion 25 of the external electrode 21 and an inner side end surface of the upper portion 26 of the external electrode 22. Thus, the upper portion 25 of the external electrode 21 and the upper portion 26 of the external electrode 22 may not cover an upper surface of the shield layer 241. The shield layer 241 may be formed similarly to the shield layer 41 except for points specifically described in this specification. Accordingly, the coil element 1 can be reduced in profile.

Figure 7:
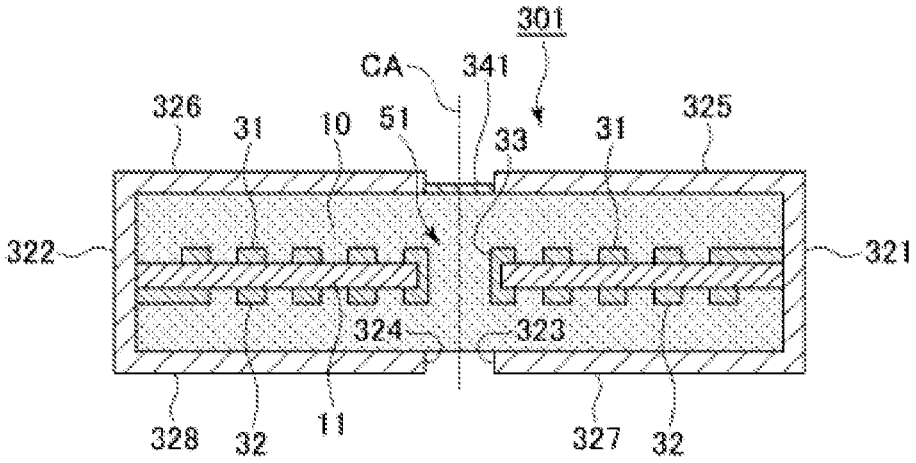
FIG. 7 is a sectional view of a coil element according to yet another embodiment of the present invention.

FIG. 7 shows a coil element 301 according to yet another embodiment of the present invention. The coil element 301 shown in FIG. 7 may be provided with an external electrode 321, an external electrode 322, and a shield layer 341 in place of the external electrode 21, the external electrode 22, and the shield layer 41 of the coil element 1 shown in FIG. 2. The external electrode 321 may be formed so that an upper portion 325 thereof covering the upper surface of the insulator body 10 has a length in the length direction (the L direction) longer than that of the upper portion 25 of the external electrode 21. Similarly, the external electrode 322 may be formed so that an upper portion 326 thereof covering the upper surface of the insulator body 10 has a length in the length direction (the L direction) longer than that of the upper portion 26 of the external electrode 22.

It may also be possible that the external electrode 321 is configured so that said upper portion 325 has an equal length in the length direction (the L direction) to that of a lower portion 327 thereof covering the mounting surface of the insulator body 10, and the external electrode 322 is configured so that said upper portion 326 has an equal length in the length direction (the L direction) to that of a lower portion 328 thereof covering the mounting surface of the insulator body 10. In this case, a distance between an inner side end surface 323 of the lower portion 327 of the external electrode 321 and an inner side end surface 324 of the lower portion 328 of the external electrode 322 may be equal to a distance between an inner side end surface of the upper portion 325 of the external electrode 321 and an inner side end surface of the upper portion 326 of the external electrode 322.

The shield layer 341 may be formed so that a dimension thereof in the length direction is substantially equal to the distance between the inner side end surface of the upper portion 325 of the external electrode 321 and the inner side end surface of the upper portion 326 of the external electrode 322. Thus, on the upper surface of the insulator body 10, the shield layer 341 may be provided between the inner side end surface of the upper portion 325 of the external electrode 321 and the inner side end surface of the upper portion 326 of the external electrode 322.

The external electrode 321 and the external electrode 322 may be formed similarly to the external electrode 21 and the external electrode 22 corresponding thereto, respectively, except for points specifically described in this specification. The shield layer 341 may be formed similarly to the shield layer 41 except for its dimensions and arrangement.

According to the coil element 301, on an upper surface side of the coil element 301, one part of magnetic flux that has penetrated the coil conductor 31 and the coil conductor 32 may be guided to pass through the shield layer 341, and the other part of magnetic flux may be guided to pass through the first plating layer 21*b* of the external electrode 321 and the first plating layer 22*b* of the external electrode 322. The one part of magnetic flux, after passing through the shield layer 341, may be further guided to pass through (the first plating layer 21*b* in) the upper portion 325 of the external electrode 321 and (the first plating layer 22*b* in) the upper portion 326 of the external electrode 322, which are provided adjacently to said shield layer 341 on the upper surface of the insulator body 10. As thus described, occurrence of leakage magnetic flux can be prevented also in the coil element 301.

Figure 8A:
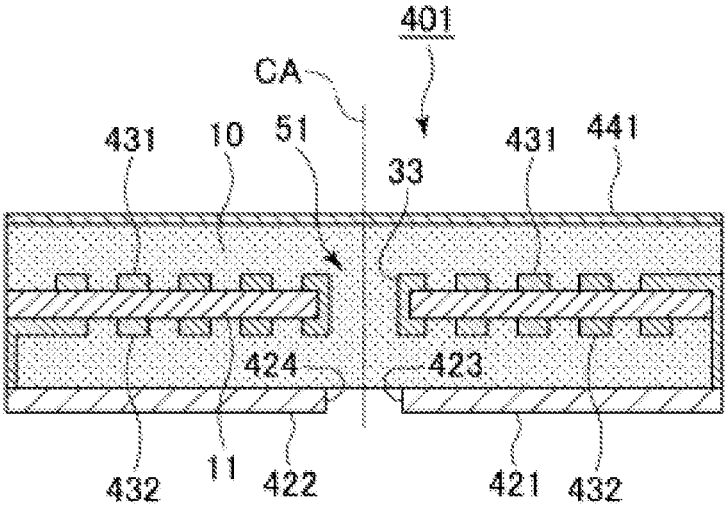
FIG. 8*a* is a sectional view of a coil element according to yet still another embodiment of the present invention.

FIG. 8*a* shows a coil element 401 according to yet still another embodiment of the present invention. The coil element 401 shown in FIG. 8*a* may be provided with an external electrode 421, an external electrode 422, a coil conductor 431, a coil conductor 432, and a shield layer 441 in place of the external electrode 21, the external electrode 22, the coil conductor 31, the coil conductor 32, and the shield layer 41 of the coil element 1 shown in FIG. 2. The external electrode 421, the external electrode 422, the coil conductor 431, the coil conductor 432, and the shield layer 441 may be formed similarly to the external electrode 21, the external electrode 22, the coil conductor 31, the coil conductor 32, and the shield layer 41, respectively, except for points specifically described in this specification.

In the coil element 401 shown in FIG. 8*a*, the external electrode 421 and the external electrode 422 may be provided only on the mounting surface of the insulator body 10. In order to establish connection with the external electrode 421, the coil conductor 431 may be formed so that an outer peripheral side end portion thereof extends downward (along a side surface). Similarly, in order to establish connection with the external electrode 422, the coil conductor 432 may be formed so that an outer peripheral side end portion thereof extends downward (along a side surface). The shield layer 441 may be formed to cover the entirety or part of the upper surface of the insulator body 10.

Figure 8B:
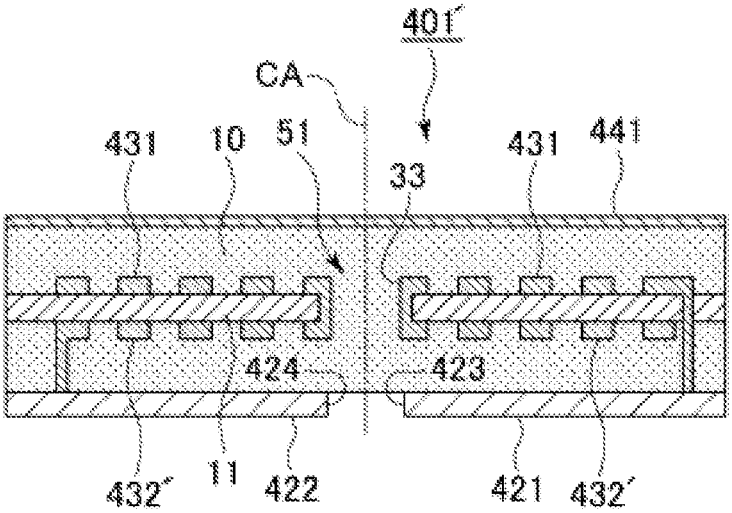
FIG. 8*b* is a sectional view of a coil element according to yet still another embodiment of the present invention.

FIG. 8*b* shows a coil element 401' according to yet still another embodiment of the present invention. The coil element 401' shown in FIG. 8*b* may be provided with a coil conductor 432' in place of the coil conductor 432 of the coil element 401 shown in FIG. 8*a*. In order to establish connection with the external electrode 422, the coil conductor 432' may be configured so that an outer peripheral side end portion thereof extends downward by passing through an inside of the insulator body 10.

According to the coil element 401, on an upper surface side of the coil element 401, magnetic flux that penetrates the coil conductor 431 and the coil conductor 432 may be guided to pass through the shield layer 441, while on a mounting surface side of the coil element 401, the magnetic flux is guided to pass through the first plating layer 21*b* of the external electrode 421 and the first plating layer 22*b* of the external electrode 422. As thus described, occurrence of leakage magnetic flux can be prevented also in the coil element 401. Similarly to the coil element 401, occurrence of leakage magnetic in the coil element 401 can be prevented also in the coil element 401'.

Figure 9:
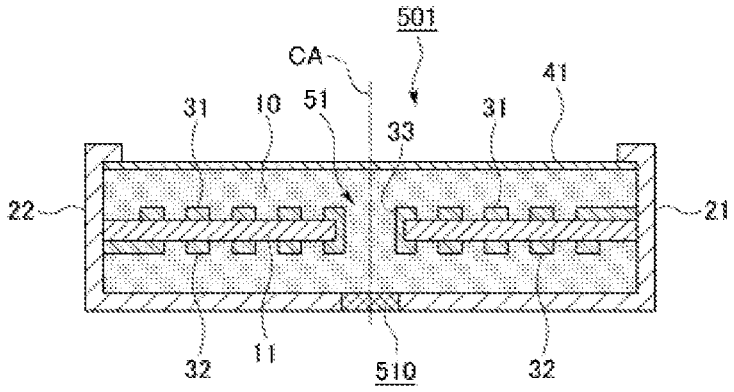
FIG. 9 is a sectional view of a coil element according to yet still another embodiment of the present invention.

FIG. 9 shows a coil element 501 according to yet still another embodiment of the present invention. The coil element 501 shown in FIG. 9 may be different from the coil element 1 shown in FIG. 2 in that the coil element 501 additionally has a spacer 510 formed of an insulating member. The spacer 510 may be made of an arbitrary insulating material having an excellent electrical insulation property. As an insulating material for the spacer 510, there can be used, for example, glass or any of various types of high heat-resistant resins in which filler particles of a metal oxide or SiO2 are dispersed. On the mounting surface of the insulator body 10, the spacer 510 may be provided between the inner side end surface 23 of the external electrode 21 and the inner side end surface 24 of the external electrode 22. The spacer 510 may be formed by, for example, applying the insulating material between the inner side end surface 23 of the external electrode 21 and the inner side end surface 24 of the external electrode 22 and curing the insulating material thus applied. Furthermore, it may also be possible that the insulating material is shaped beforehand into a plate shape to be fitted into a gap between the inner side end surface 23 of the external electrode 21 and the inner side end surface 24 of the external electrode 22, and this plate-shaped body made of the insulating material is used as the spacer 510. Furthermore, it may also be possible that the spacer 510 is formed by applying a commercially available solder resist between the inner side end surface 23 of the external electrode 21 and the inner side end surface 24 of the external electrode 22. Since the spacer 510 is provided, the external electrode 21 and the external electrode 22 can be reliably electrically insulated from each other. Furthermore, when made of a thermosetting epoxy resin, the spacer 510 can function as a solder resist.

Figure 10:
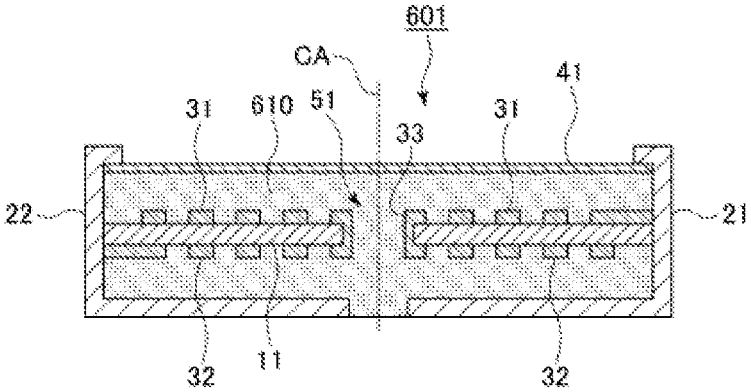
FIG. 10 is a sectional view of a coil element according to yet still another embodiment of the present invention.

FIG. 10 shows a coil element 601 according to yet still another embodiment of the present invention. The coil element 601 shown in FIG. 10 may be different from the coil element 1 shown in FIG. 2 in that the insulator body 10 is filled between the inner side end surface 23 of the external electrode 21 and the inner side end surface 24 of the external electrode 22. In other words, in the coil element 601, the external electrode 21 and the external electrode 22 may be embedded in the insulator body 10 to such a degree that respective mounting surfaces of the external electrodes 21 and 22 and the mounting surface of the insulator body 10 are flush with each other. According to the coil element 601, without the need to additionally form a spacer, the external electrode 21 and the external electrode 22 can be reliably electrically insulated from each other.

Figure 11:
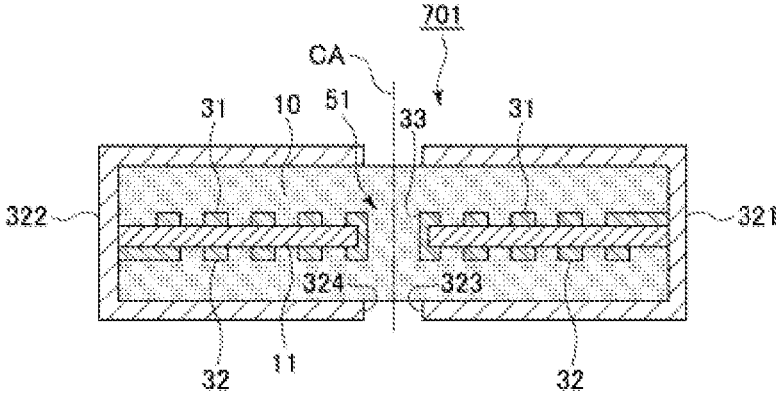
FIG. 11 is a sectional view of a coil element according to yet still another embodiment of the present invention.

FIG. 11 shows a coil element 701 according to yet still another embodiment of the present invention. The coil element 701 shown in FIG. 11 may be formed similarly to the coil element 301 shown in FIG. 7 except that the shield layer 341 is omitted from the coil element 301. Also in the coil element 701, similarly to the coil element 301, it may also be possible that the external electrode 321 is configured so that the upper portion 325 thereof has an equal length in the length direction (the L direction) to that of the lower portion 327 thereof covering the mounting surface of the insulator body 10, and the external electrode 322 is configured so that the upper portion 326 thereof has an equal length in the length direction (the L direction) to that of the lower portion 328 thereof covering the mounting surface of the insulator body 10.

According to the coil element 701, on an upper surface side and a mounting surface side of the coil element 701, magnetic flux that has penetrated the coil conductor 31 and the coil conductor 32 may be guided to pass through the first plating layer 21*b* of the external electrode 321 and the first plating layer 22*b* of the external electrode 322. As thus described, occurrence of leakage magnetic flux can be prevented also in the coil element 701.

Figure 12:
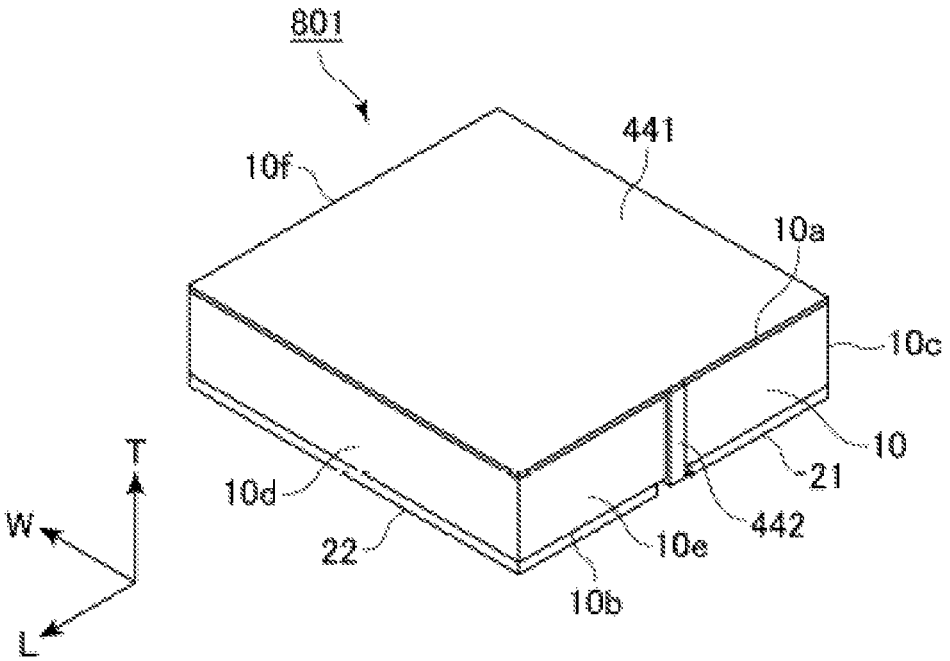
FIG. 12 is a perspective view, as seen from an upper surface side, of a coil element according to yet still another embodiment of the present invention.
Figure 13:
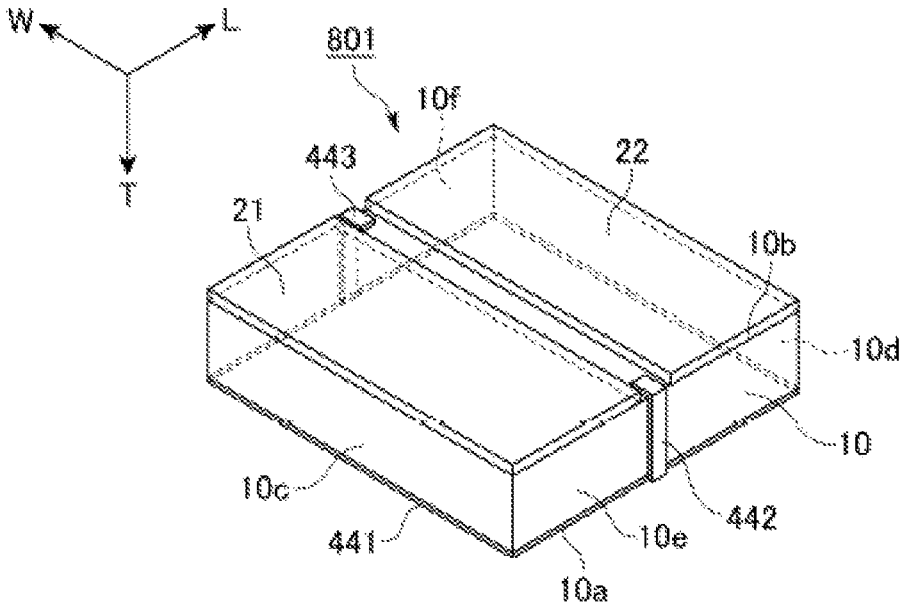
FIG. 13 is a perspective view, as seen from a mounting surface side, of the coil element shown FIG. 12.

FIG. 12 and FIG. 13 show a coil element 801 according to yet still another embodiment of the present invention. The coil element 801 shown in FIG. 12 and FIG. 13 may be different from the coil element 401 shown in FIG. 8 in that a connection conductor 442 and a ground electrode 443 are provided in addition to a configuration of the coil element 401. Except for that, the coil element 801 may be formed similarly to the coil element 401.

As shown in the figures, the coil element 801 may be provided with one set of ground electrodes 443 and one set of connection conductors 442 that connect each of said one set of ground electrodes 443 to the shield layer 441. The one set of ground electrodes 443 may both be provided on the mounting surface of the insulator body 10. The ground electrodes 443 may be configured so that, when the coil element 1 is mounted on a circuit board, the ground electrodes 443 are connected to a ground of said circuit board. The one set of connection conductors 442 may be provided on a first side surface 10*e* and a second side surface 10*f*, respectively. One end portion of each of the connection conductors 442 may be connected to the shield layer 441, while the other end portion thereof may be connected to a corresponding one of the ground electrodes 443. The connection conductors 442 and the ground electrodes 443 may be formed to contain a metal having excellent electrical conductivity and thus be made of, for example, Ag, Pd, Cu, Al or any alloy of these elements.

In the coil element 801, the shield layer 441 may be connected to the ground of the circuit board via the connection conductors 442 and the ground electrodes 443. Thus, the shield layer 441 of the coil element 801 may function not only as a magnetic shield but also as an electric field shield.

The dimensions, materials, and arrangements of the various constituent components described in this specification are not limited to those explicitly described in the embodiments, and the various constituent components can be modified to have arbitrary dimensions, materials, and arrangements within the scope of the present invention. Furthermore, constituent components not explicitly described in this specification can also be added to the embodiments described, and some of the constituent components described in the embodiments can also be omitted.

What is claimed is:

1. A coil element, comprising:

an insulator body made of an insulating material and having a mounting surface and an upper surface opposed to said mounting surface;

a coil conductor embedded in the insulator body;

an external electrode electrically connected to the coil conductor and disposed on the mounting surface of the insulator body;

a shield layer provided on the upper surface of the insulator body and having a larger magnetic permeability than the insulator body; and a plating layer formed to cover a surface of the external electrode and having a larger magnetic permeability than the insulator body, wherein the plating layer is formed to be thicker than the shield layer, wherein the coil element is configured to have a dimension in a length direction thereof larger than its dimension in a width direction thereof, the external electrode is provided with a first external electrode component electrically connected to one end portion of the coil conductor and a second external electrode component electrically connected to the other end portion of the coil conductor, the first external electrode component and the second external electrode component are disposed away from each other in the length direction of the coil element, and a distance in the length direction is provided between a first end surface of the first external electrode and a second end surface of the second external electrode, and wherein the distance accounts for greater than zero but less than 30% of a length dimension of the coil element in the length direction.

2. The coil element according to claim 1, wherein the plating layer is made of plated nickel.

3. The coil element according to claim 1, wherein the shield layer is configured so as not to cover side surfaces of the insulator body.

4. The coil element according to claim 1, wherein the shield layer has a magnetic permeability five or more times as high as a magnetic permeability of the insulator body.

5. The coil element according to claim 1, wherein the coil element has a length of 0.8 mm or less in a thickness direction thereof.

6. The coil element according to claim 1, wherein the coil conductor is configured and disposed so that the coil axis of the coil conductor is perpendicular to the mounting surface of the insulator body.

7. The coil element according to claim 1, wherein at least part of the external electrode is embedded in the insulator body.

8. The coil element according to claim 1, wherein the external electrode is provided with a first external electrode component electrically connected to one end portion of the coil conductor and a second external electrode component electrically connected to the other end portion of the coil conductor, and the coil element further comprises an insulator provided between the first external electrode component and the second external electrode component.

9. The coil element according to claim 8, wherein the insulator is a solder resist.

10. The coil element according to claim 1, wherein the shield layer has a thickness of 2 μm or less.

11. The coil element according to claim 1, wherein the shield layer is formed to have a magnetic permeability that exhibits an anisotropy.

12. The coil element according to claim 11, wherein the shield layer is formed so that a magnetic permeability thereof in a direction perpendicular to a direction of a coil axis of the coil conductor is larger than a magnetic permeability thereof in a direction parallel to the coil axis.

13. The coil element according to claim 11, wherein the shield layer has a plurality of flat-shaped metal particles.

14. The coil element according to claim 13, wherein the flat-shaped metal particles have a thickness of 2 μm or less in a shortest axis direction thereof.

15. The coil element according to claim 13, wherein the flat-shaped metal particles have an aspect ratio of 4 or more, the aspect ratio being a ratio of a length of the flat-shaped metal particles in a longest axis direction thereof with respect to a length thereof in the shortest axis direction.

16. The coil element according to claim 13, wherein the flat-shaped metal particles assume such a posture that a short axis direction thereof is parallel to the direction of the coil axis of the coil conductor.

17. A coil element, comprising:

an insulator body made of a magnetic material;

a coil conductor embedded in the insulator body; and an external electrode electrically connected to the coil conductor, wherein the external electrode has an upper portion covering at least part of an upper surface of the insulator body and a lower portion covering at least part of a mounting surface of the insulator body, and a plating layer having a larger magnetic permeability than the insulator body is provided on each of an upper surface of the upper portion of the external electrode and a lower surface of the lower portion of the external electrode, wherein the external electrode is provided with a first external electrode component electrically connected to one end portion of the coil conductor and a second external electrode component electrically connected to the other end portion of the coil conductor, the first external electrode component and the second external electrode component are disposed away from each other in a length direction of the coil element, and a distance in the length direction is provided between a first end surface of the first external electrode and a second end surface of the second external electrode, and wherein the distance accounts for greater than zero but less than 30% of a length dimension of the coil element in the length direction.

* * * * *